US005786077A

United States Patent [19]

McLaughlin

[11] Patent Number: 5,786,077

[45] Date of Patent: Jul. 28, 1998

[54] ANTI-SLIP COMPOSITION FOR PAPER

[76] Inventor: John R. McLaughlin, 240 Highview La., Media, Pa. 19063

[21] Appl. No.: 611,634

[22] Filed: Mar. 6, 1996

Related U.S. Application Data

[63] Continuation-in-part of Ser. No. 475,071, Jun. 7, 1995, abandoned.

[51] Int. Cl.[6] ..... B32B 5/16

[52] U.S. Cl. ..... 428/331; 428/332; 428/341; 428/342

[58] Field of Search ..... 428/331, 341, 428/342, 332; 106/462, 404, 466, 467, 481, 483

[56] References Cited

U.S. PATENT DOCUMENTS

| | | | |
|---|---|---|---|
| 2,244,325 | 6/1941 | Bird | 252/313.2 |
| 2,375,738 | 5/1945 | White | 252/309 |
| 2,574,902 | 11/1951 | Beechtold et al. | 252/313.2 |
| 2,630,410 | 3/1953 | Clapsadle et al. | 252/313.2 |
| 2,643,048 | 6/1953 | Wilson | 383/32 |
| 2,872,094 | 2/1959 | Leptien | 229/3.5 R |
| 3,440,174 | 4/1969 | Albrecht | 252/313.2 |
| 3,462,374 | 8/1969 | Klosak | 252/313.2 |
| 3,468,813 | 9/1969 | Murdick | 252/313.2 |
| 3,538,015 | 11/1970 | Mindick et al. | 502/232 |
| 3,711,416 | 1/1973 | Payne et al. | 252/313.2 |
| 3,836,391 | 9/1974 | Payne et al. | 428/325 |
| 3,895,164 | 7/1975 | Carstens et al. | 428/329 |
| 3,901,987 | 8/1975 | Payne et al. | 428/219 |
| 4,418,111 | 11/1983 | Carstens | 428/145 |
| 4,798,653 | 1/1989 | Rushmore | 162/168.3 |
| 4,863,796 | 9/1989 | Wason | 428/331 |
| 4,927,498 | 5/1990 | Rushmore | 162/168.3 |
| 4,954,220 | 9/1990 | Rushmore | 162/168.3 |
| 4,980,024 | 12/1990 | Andersson et al. | 162/168.3 |
| 4,988,561 | 1/1991 | Wason | 428/331 |
| 5,081,085 | 1/1992 | Wason | 502/63 |
| 5,316,576 | 5/1994 | Freeman | 106/483 |
| 5,339,957 | 8/1994 | Carstens | 206/386 |

*Primary Examiner*—H. Thi Le
*Attorney, Agent, or Firm*—Paul and Paul

[57] ABSTRACT

An aqueous anti-slip coating composition for paper includes 10–50% by weight insoluble silicate particles of 180–300 millimicron average particle size, and 0.5–10% by weight dispersant.

4 Claims, 1 Drawing Sheet

ANTI-SLIP COMPOSITION FOR PAPER

This is a continuation-in-part of application Ser. No. 08/475,071, filed Jun. 7, 1995 not abandoned.

BACKGROUND OF THE INVENTION

1. Field of the Invention

The present invention relates to an aqueous coating composition containing insoluble silicates for imparting anti-slip properties to paper.

2. Brief Description of the Prior Art

The ability of silica and alumina to act as external frictionizing agents when applied to the surface of paper, paperboard or corrugated boxes is known. They are typically applied as aqueous coating compositions including colloidal particles.

A colloid can be described as comprising particles of liquid, solid or gas, less than one micron in size. A colloidal sol comprises solid particles suspended in a liquid. The suspended particles in the sols can be either cationic or anionic. The preparation of aqueous colloidal silica sols is well known in the art and is described for example in U.S. Pat. Nos. 2,244,325; 2,375,738; 2,574,902; 3,440,174; 3,462,374; 3,468,813; and 3,538,015. Typically silica sols are prepared by controlled ion exchange of soluble silicate salts such as sodium silicate followed by the controlled growth of particles.

The preparation of stable high solids aqueous dispersions of colloidal silica particles by the deagglomeration of dry aggregates of colloidal particles of fumed or pyrogenic silica in water containing stabilizing borate ions is disclosed in U.S. Pat. No. 2,630,110. Particle sizes are not disclosed.

The use of an aqueous colloidal silica sol to impart anti-slip, anti-skid, or frictionizing properties to paper is described in U.S. Pat. Nos. 2,643,048 and 2,872,094. The application of aqueous dispersion of colloidal silica is often referred to as "frictionizing," "imparting anti-skid or anti-slip properties," or "improving the angle of slide."

Various improvements in the use of colloidal silica sols to impart anti-slip patents for are disclosed, for example, in U.S. Pat. Nos. 3,711,416; 3,836,391; 3,901,987; 4,418,111 and 4,980,024, typically by the addition of compatible chemicals. These improvements encompass: higher concentration of solids, better cleanability upon drying on metal equipment, lower corrosion rates of metal surfaces, greater retention of slide angles after multiple slides, freeze-thaw stability and resistance to mold and fungus growth in the dispersion.

The 1970's saw growing concern over the characteristic of colloidal silica sols to dry into hard glassy solids that were abrasive to equipment and difficult to remove from metal surfaces, where they tend to build up. These problems provided an incentive for development of dispersions of colloidal alumina frictionizing agents. U.S. Pat. Nos. 3,895,164 and 5,339,957 relate to the use of dispersions of colloidal alumina having a particle size of up to 100 millimicrons. These colloidal alumina dispersions carry a positive, cationic rather than a negative, anionic charge as do the silica dispersions. Unlike the silica sols, the alumina sols do not form hard gels, however, they are corrosive because they have a low pH, and are more expensive than comparable silica dispersions.

An anti-slip coating must have at least six months of shelf life or stability in order to be commercially useful. Stability of colloidal dispersions covers a variety of characteristics of the dispersion including:

a) resistance to chemical growth of the ultimate particles measured by an increase in size over time.

b) resistance to agglomeration and clustering of ultimate particles into larger particles.

c) resistance to gravitational settling.

Colloidal particles are stabilized by either of two mechanisms:

a) the specific adsorption of ions onto the surface of the colloid to provide a strong electrostatic repulsive charge or b) steric stabilization wherein a long chain polymer coasts the surface of the particles and keeps them from making contact with each other.

A description of these two forms of stabilization is found in "Introduction to Modern Colloid Science" by Robert J. Hunter, Oxford University Press, Oxford, New York 1993, pp. 54, 212 and 223.

Various dispersions of either amorphous silica or amorphous alumina are available commercially to increase the coefficient of friction of paper and paper compositions. Typical products include: Nyacol™ 9950 (EKA Aktiebolag, Bohus, Sweden), Ludoxm™ CLX (DuPont de Nemours Company, Wilmington, Del. U.S.A.), Nalcoag™ 7604 LF and 8668 (Nalco Chemical Company, Naperville, Ill., U.S.A.), Fuller WB4772, (H. B. Fuller Company, St. Paul, Minn., U.S.A.), and Dispal™ 11N7-12 (Vista Chemical Company, Houston, Tex. U.S.A.).

All of the above listed products are used commercially to increase the coefficient of friction of packaging papers or to treat the surface of paper containing a large percentage of recycled paper prior to windup into rolls.

Commercial products contain particles of silica or alumina ranging in size from 12 millimicrons (Nalcoag™ 7604LF) up to 170 millimicrons (Dispal™ 11N7-12). The basic or ultimate particles in such products are formed to an exact size during the initial chemical manufacturing process by, for example, polymerization of silicic acid, precipitation of aluminum hydroxide from aluminum alkyl, or the gas phase hydrolysis of silicon tetrachloride. When dried or concentrated these dispersions form larger agglomerates.

Small particles often combine together into larger micron sized agglomerates during drying. Dry powder agglomerates of small particles are mechanically deagglomerated and dispersed in water and stabilized with acidic or basic ions to form dispersions. Depending on the level of shear in the mixer, the agglomerates may or may not be reduced to the ultimate particle size during the dispersion process.

Despite the many commercial anti-slip products available for frictionizing paper, there remains a need for a low cost, highly efficient material that overcomes the mechanical build-up problems associated with use of colloidal silica.

SUMMARY OF THE INVENTION

It has been discovered that, at the same application dosage as commercially available anti-slip coatings containing colloidal silica or colloidal alumina particles, larger, but still colloidal, particles of insoluble silicates are more efficient in increasing the coefficient of friction of paper than the commercially available anti-slip compositions.

It is thus an object of this invention to provide stable aqueous dispersions of these larger colloidal silicate particles, which have an average particle size from about 180 millimicrons to about 300 millimicrons, and which may be coated onto paper surfaces to improve their anti-skid properties. Surprisingly, these coating compositions are resistant to gravitational settling of the colloidal silicate particles, even when the particle size extends up to about 300 millimicrons.

It is a further object of this invention to provide a method for producing stable aqueous dispersions of these insoluble colloidal silicate particles, the method comprising wet milling silicates having a large particle size to achieve the desired 180 to 300 millimicron colloidal size, using an agitated media mill while providing dispersants to act as stabilizers.

The present invention thus provides aqueous coating compositions for use in forming frictionizing coatings on paper and board products. The aqueous coating composition of the present invention comprises a stable aqueous dispersion of insoluble colloidal silicate particles. The colloidal particles preferably have an average particle size from about 180 millimicrons to 300 millimicrons. The colloidal particles employed can be crystalline sodium alumino silicates, preferably Zeolite A, a synthetic crystalline alumino silicate, described in U.S. Pat. No. 2,882,243, and there disclosed to have the chemical composition $1.0\pm0.2\ M_{2/n}$: $Al_2O_3$: $1.85\pm0.5\ SiO_2$: Y $H_2O$, where "n", "M", and "Y" are as defined therein Alternatively, the colloidal particles employed can be amorphous metallic silicate, preferably sodium alumino silicates. The coating composition further contains a stabilizer, which is believed to be adsorbed onto the surface of the particles, and water. The stabilizer is selected from either anionic surfactants or cationic surfactants, depending on the pH of the paper formulation.

The present invention also provides a process for producing a frictionizing coating on paper. This process comprises wet milling silicate particles in an agitated media mill to produce colloidal particles having an average particle size in the range from 180–300 millimicrons. A stabilizer is added to the water in the mill, where it is believed to be absorbed onto the freshly milled surfaces, to provide an aqueous coating composition, which is subsequently coated onto paper stock using conventional paper coating techniques, thereby providing a superior frictionizing coating on the paper.

DETAILED DESCRIPTION OF THE PREFERRED EMBODIMENTS

Figure 1:
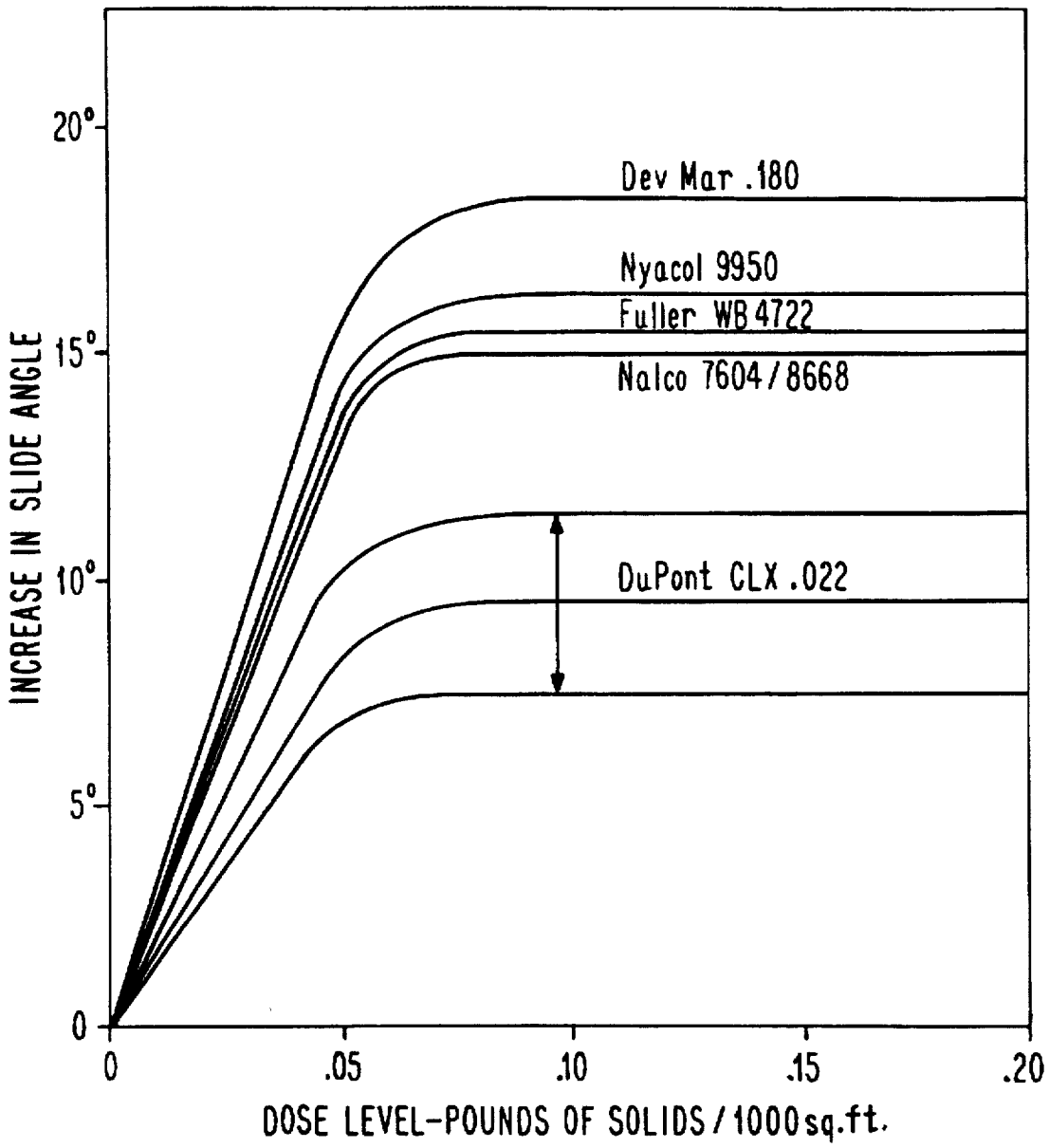
FIG. 1 is a plot of the increase in slide angle shown as a function of the dose level of frictionizing coating composition (in pounds of solids per one thousand square feet of paper) given for a coating composition prepared according to the present invention and compared with various prior art commercial frictionizing compositions.

The preferred process for making the aqueous coating dispersions of the present invention comprises wet milling insoluble inorganic silicate particles in an agitated media mill. Preferably, the process feed comprises relatively large inorganic silicate materials, such as silicate materials having an average particle size greater than about 2 microns. Inorganic silicate materials having such a relatively large particle size tend to be inexpensive. However, because of their large particle size they are difficult to disperse to provide homogeneous aqueous coatings compositions, and the large particles tend to quickly settle out of the aqueous coating composition under the influence of gravity. Further, they tend to impart an esthetically undesirable roughness to the surface of the paper being coated.

The particle size of the silicate employed in the aqueous coating compositions of the present invention is determined by several processing variables. In addition, the mill type can determine how quickly a particular size can be achieved.

Other factors which affect the ultimate size of the ground material, as well as the time and energy it takes to achieve them include the following:

1) In wet media milling, smaller media are more efficient in producing finer particles within short milling times of 35 minutes or less.
2) More dense media and higher tip speeds are desired to impart more energy to the particles being ground thereby shortening the milling time.
3) As the particles are reduced in diameter, surface areas increase, and a dispersing agent is generally used to keep small particles from agglomerating. In some cases dilution alone can help achieve a particular ultimate particle size, but a dispersing agent is generally used to achieve long-term stability against agglomeration and settling.

The above and other factors that influence grinding performance are discussed in the paragraphs that follow.

As used herein "particle size" refers to weight average, not a number average, particle size as measured by conventional particle size measuring techniques such a sedimentation, photon correlation spectroscopy, field flow fractionation, disk centrifugation, transmission electron microscopy, and dynamic light scattering. A dynamic light scattering device such as a Horiba LA-900 Laser Scattering particle size analyzer (Horiba Instruments of Japan) is preferred by the present inventor, because it has advantages of easy sample preparation and speed.

Milling Equipment

Inorganic solids can be wet milled to particle size levels that are currently not achievable with dry milling techniques.

Commercial sand mills and stirred media mills are designed to break apart agglomerates of pre-sized particles rather than grind and shatter large discrete particles. They are typically used to impart shear forces to break apart clusters of small particles where the size of the particles was already established in an earlier chemical process.

The milling equipment preferred for the practice of the invention are generally known as media mills, wherein grinding media are stirred in a closed milling chamber. The preferred method of agitation is by means of a rotating shaft. The shaft may be provided with disks, arms, pins, or other attachments. The portion of the attachment that is radially the most remote from the shaft is referred to herein as the "tip." The mills may be operated in a batch or continuous mode and in either a vertical or horizontal position.

A horizontal continuous media mill equipped with an internal screen having openings that are ½ to ⅓ the media diameter is preferred. In a horizontal media mill, the effects of gravity on the media are negligible, and high loadings of media are possible (e.g., loadings of up to about 92% of chamber volume).

An increase in the amount of grinding media in the chamber will increase grinding efficiency by decreasing the distances between individual particles and increasing the number of surfaces available to shear the material to be comminuted. The amount of grinding media can be increased until the grinding media constitutes up to about 92% of the mill chamber volume. At levels substantially above this point, the media does not move easily and both media wear and mill wear increases.

Starting Materials

The size of the feed material that is to be ground is not critical but is usually not more than 20 times larger than the final product. Shorter milling times can be achieved if smaller starting materials are used. Thus, it is preferable to start with particles that are as small as is economically feasible to reduce time in the milling.

Grinding Media

Acceptable grinding media for the practice of the present invention include glass, metal and ceramic beads. Preferred glass beads include barium titanate (leaded), soda lime (unleaded), and borosilicate. Preferred metals include carbon steel and stainless steel. Preferred ceramics include yttrium-stabilized zirconium oxide, zirconium silicate, fused alumina and tungsten carbide.

Each type of media has its own advantages and disadvantages. For example, metals have high specific gravity, which increases grinding efficiency due to increased impact energy. Metal costs range from low to high, but metal contamination of final product can be an issue. Glass beads are advantageous from the standpoint of low cost and the availability of smaller sizes. The specific gravity of glasses and the hardness of glass however, is lower than other media and significantly more milling time is required to reach the same end point as a harder, more dense bead. Finally, ceramics are advantageous from the standpoint of low wear and low contamination, ease of cleaning, and high hardness. They are, however, very expensive.

The grinding media used for particle size reduction are preferably spherical. As noted previously, smaller grinding media sizes result in smaller ultimate particle sizes. The grinding media for the practice of the present invention preferably have an average size ranging from about 0.004 to 15 mm, more preferably from about 0.3 to 0.4 mm. The most preferred grinding media for the purpose of the invention is yttrium-stabilized zirconium oxide.

Fluid Vehicles

Fluid vehicles in which the particles may be ground and dispersed include water and organic liquids. In general, as long as the fluid vehicle used has a reasonably low viscosity and does not adversely affect he chemical or physical characteristics of the particles, the choice of fluid vehicle is optional. Water is ordinarily preferred.

Wetting Agents/Dispersing Agents

Wetting agents act to reduce the surface tension of the fluid to wet newly exposed -surfaces that result when particles are fractured. Preferred wetting agents for performing this function are non-ionic surfactants.

Dispersing agents stabilize the resulting slurry of milled particles by adsorbing onto the particles where they provide either (1) a positive or negative electric charge on the milled particles, or (2) steric blocking through the use of an adsorbed large bulking molecule. An electric charge is preferably introduced by means of anionic and cationic surfactants adsorbed onto the particles while steric blocking is preferably performed by adsorbed polymers which prevent interparticle contact.

Preferred surfactants for the practice of the invention include non-ionic wetting agents (such as Tdtonim™ X-100 and Triton CF-10, sold by Union Carbide, Tarrytown, N.Y.; and Neodol™ 91-6, sold by Shell Chemical, Houston, Tex.); anionic surfactants (such as Tamol™ 731, Tamol 931 and Tamol SN, sold by Rohm and Haas, Philadelphia, Pa., Colloid™ 226/35, sold by Rhone Poulenc, and Darvan 1, sold by R.T. Vanderbilt of Norwalk, Conn.); and cationic surfactants (such as Disperbyke™ 182 sold by Byke Chemie, Wallingford, Conn.), and cationic polymers (such as Kymene™), sold by Hercules, Inc., Wilmington, De. The most preferred dispersion agent is an anionic surfactant such as Tamol SN or Darvan 1.

Surfactant additions of 0.5% to 10% by weight of suspended solids are typically used. The amount of added material actually adsorbed onto the particle surface depends on the suspending fluid, the temperature and pH.

Aqueous Coating Compositions

Aqueous dispersions of colloidal silica or colloidal alumina stabilized with adsorbed cations have low viscosities of 20–30 centipoises and have six months to one year shelf lives. The stability of these dispersions comes from a combination of small particles size and high ionic repulsive forces. As the particle size of colloidal sols increases the shelf life shortens due to particle setting. Unlike the colloidal silicas and alumina dispersions, the dispersions of large silicate particles are thixotropic and at 25–30% solids form stable gel-like suspension which prevent the large particles from settling. These suspensions are very sensitive to shear and readily liquefy to slurries having viscosities on the order of 30 centipoise. This enables the compositions to be stable and yet pumpable for about six months. After about six months there is measurable particle growth but little or no settling.

Paper Coating Procedure

Conventional paper coating techniques can be employed to apply the aqueous compositions of the present invention. For example, Kraft paper mills typically apply an anti-slip coating to a Kraft paper web using spray nozzles. However, other application techniques known in the art can also be used.

The anti-slip coatings described in this invention were tested to determine flow rates through commercial spray equipment with the following results:

| Liquid Pressure | Spray Rate |
|---|---|
| 3 psi | 4.9gallons/hour |
| 5 psi | 9.0 |
| 10 psi | 11.0 |
| 15 psi | 12.8 |

These results show that the material can be spray applied in either single gun or multiple gun applicators in paper mills.

Coating/Slip Angle Test Procedures

The anti-slip coatings of this invention were tested using TAPPI test method T-542 om-88. In this procedure the coated paper is preconditioned to a relative humidity of 20–30% . The specimens are attached to a sled which is placed on top of a flat surface also coated with a test sample. After a 30 second dwell time the flat surface is inclined at a rate of 1.5% per second until the sled moves 25 mm to a stop. The procedure is repeated three times and the angular displacement is reported to the nearest one half degree on the third slide. Five specimens are run and the slide angle is reported as the average, minimum and maximum values of the five specimens.

Using this test procedure it was found that an anti-slip coating prepared from aqueous coating composition of the present invention provided a 15° improvement in slide angle with 14 to 37% less applied solids per 1000 sq. foot than silica and alumina anti-slip coatings (see Table B below).

EXAMPLES

The following examples, as well as the foregoing description of the invention and its various embodiments, are not intended to be limiting of the invention but rather are illustrative thereof. Those skilled in the art can formulate further embodiments encompassed within the scope of the present invention.

Comparative Example 1

A feedstock consisting of 30% by weight 4.6 micron Zeolite A was dispersed in water containing no wetting aids or dispersing aids. This feedstock was pumped into a 4 liter media mill mode LMC 4 (Netzsch Inc.) containing an 85% charge of 0.4–0.6 mm zirconium silicate beads. The agitator speed was 2200–2300 rpm. After 3 passes, the particle size was reduced to 0.43 microns. The dispersion however, was not stable and settled upon standing.

Comparative Example 2

Comparative Example 1 was repeated, except that the feedstock had 40% solids. After 3 passes, the particle size was reduced to 0.36 microns, but the viscosity increased to 1200 centipoises. The dispersion was not stable, and settled upon standing. The addition of 8% of Tamol SN and Tamol 731 improved the stability to acceptable levels.

Comparative Example 3

Comparative Example 1 was repeated, except that the solids of the feedstock were 50%. After 3 passes, the particle size was reduced to 0.5 microns. The viscosity climbed to 1200 centipoises and the dispersion was unstable.

Comparative Example 4

Comparative Example 1 was repeated, except that the feedstock had 60% solids. After three passes, the particle size was only reduced from 4.6 microns to 1.3 micron. Due to the large particles, the viscosity of the dispersion remained low but the dispersion was still unstable and settling occurred.

Example 1

A feedstock was prepared by dispersing 4.6 micron Zeolite A at 30% solids. No dispersing agent was employed. The feedstock was fed to a Netzsch media mill model LMZ-10 filled with 0.2–0.3 mm zirconium silicate beads charged to 90% of maximum fill. The particle size was reduced as a function of residence time as shown below in Table A. The dispersion had limited stability, and some settling occurred.

TABLE A

| Residence Time | Particle Size |
|---|---|
| 0 minutes | 4.6 micron |
| 10 minutes | 0.45 micron |
| 15 minutes | 0.39 micron |
| 20 minutes | 0.29 micron |
| 25 minutes | 0.18 micron |

Example 2

Albemarle Corporation's Zeolite A of 1.5 micron size was milled in a Netzsch media mill model LMZ-10 containing 0.3–0.4 mm Zirconia beads. After 300 minutes of elapsed running time equal to 28 minutes of residence time, the average particle size was 0.163 microns. The dispersion had limited stability. However, the addition of 8% Tamol SN and 2 percent Tamol 731 improved the stability to acceptable levels.

Example 3

Huber's amorphous sodium magnesia aluminosilicate, Hydrex -P, having a 8.9 micron particle size was milled at 21% solids in water with 4% Tamol SN anionic surfactant in Netzsch LMZ 4 media mill using 90% fill of 0.09 mm glass beads from Potters Industry. fter 60 minutes of elapsed time, the particle size was reduced to 0.183 microns. The suspension had a viscosity of 30 centipoises and was stable to both gelling or settling.

Paper Frictionizing Tests

A sample of 0.18 micron Huber Hydrex-P was tested to determine the improvement in surface coefficient of friction which was imparted by various dosages of this material. The results were compared to commercial anti-slip dispersions at the same dosages. The results of these tests are shown in FIG. 1 and Table B. The results indicate that the larger particle size anti-slip coatings improve the slide angles to a greater absolute amount. The results also indicate that these dispersions can achieve equivalent slide angles at lower dosages than the commercial products.

TABLE B

| Product | Particle Size Millimicrons | Percent Solids | Dosage Required For +15° Slide Angle | Dosage Relative to Hydrex-P |
|---|---|---|---|---|
| DuPont CLX | 22 | 46% | not achievable | |
| Nalco 7604 LF | 12 | 35% | 0.075 lbs. | 1.58 |
| Nalco 8668 | 60 | 50% | 0.075 lbs. | 1.58 |
| Nyacol 9950 | 80 | 50% | 0.055 lbs. | 1.16 |
| Fuller WB 4722 | | 21% | 0.065 lbs. | 1.37 |
| Hydrex-P | 180 | 21% | 0.0475 lbs. | 1.00 |

Various modifications can be made in the details of the various embodiments of the processes and compositions of the present invention, all within the scope and spirit of the invention and defined by the appended claims.

I claim:

1. A coated paper having improved anti-skid properties, the paper having at least one of its surfaces coated with a frictionizing coating of at least 0.02 pounds of insoluble colloidal silicate particles per 1000 sq. ft. of paper surface area, said silicate particles having an average particle size of 180 millimicrons to 300 millimicrons.

2. A coated paper according to claim 1 wherein the insoluble silicate particles are crystalline sodium alumino silicate.

3. A coated paper according to claim 2 wherein the insoluble silicate particles are Zeolite A.

4. A coated paper according to claim 1 wherein the insoluble silicate particles are amorphous sodium alumino silicate.

* * * * *